US006223681B1

(12) United States Patent
Foreman

(10) Patent No.: US 6,223,681 B1
(45) Date of Patent: May 1, 2001

(54) REMUS POSITIVE LOCK SECURING APPARATUS

(75) Inventor: Carl R. Foreman, Rehoboth, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/393,075

(22) Filed: Sep. 7, 1999

(51) Int. Cl.[7] ..... B63B 23/00

(52) U.S. Cl. ..... 114/377; 294/103.1; 114/239; 114/51

(58) Field of Search ..... 294/103.1, 82.23; 114/312, 313, 322, 259, 377, 51, 238, 239

(56) References Cited

U.S. PATENT DOCUMENTS 4,240,657 * 12/1980 Feighery ..... 294/103.1

4,516,517 * 5/1985 Ayers ..... 114/51

FOREIGN PATENT DOCUMENTS

1705222 * 1/1992 (SU) ..... 294/103.1

* cited by examiner

*Primary Examiner*—Ed Swinehart
(74) *Attorney, Agent, or Firm*—Michael J. McGowan; Robert W. Gauthier; Prithvi C. Lall

(57) ABSTRACT

The present invention is an apparatus for launching or retrieving a vessel. This apparatus includes a first vertical member having a top and a bottom end. A lower vessel engagement hook is positioned at the lower end of the vertical member. A second vertical member is positioned in parallel spaced relation to the first vertical member. An upper vessel engagement structure is positioned at the lower end of the second vertical member in spaced opposed relation to the lower vehicle engagement hook. The second vertical member moves axially upwardly and downwardly to allow for engagement with the vessel.

20 Claims, 2 Drawing Sheets

REMUS POSITIVE LOCK SECURING APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to ships and more particularly to means for launching or recovering small craft from a mother ship.

(2) Description of the Prior Art

The prior art discloses a number of different devices for launching a small boat or other vessel from or recovering a small boat or other vessel to a mother ship.

U.S. Pat. No. 4,964,358 to Sandrow, for example, discloses a small boat or dinghy rigging mechanism which is provided to permit the expeditious recovery, hoisting and stowing of a small boat or dinghy in an upright position at the stern of a main vessel. The rigger equipment may be detachably affixed for use directly on the transom of a vessel or adapted to be detachably secured at the trailing edge of a platform such as a swim platform that is behind the transom.

U.S. Pat. No. 5,133,275 to Maurizio discloses an on board dinghy cradle which comprises a framework of hollow tubings that are secured together by fittings and connectors. The framework includes bottom cross members which extend across the width of the dinghy at a predetermined distance below the bottom surface thereof. Side tubings are also provided for positioning one side of the dinghy close to a supporting surface for the cradle, such as a swim platform, and to keep the dinghy from moving away as it is being boarded or left. The cradle is pivotably mounted to the supporting structure so it can be pivoted to a vertical storage position, having the dinghy, with or without a small motor attached thereto, up and out of the water.

U.S. Pat. No. 5,522,341 to Green discloses an apparatus for raising a small boat and outboard motor from a position in the water to a stored position against the mother vessel with the outboard motor substantially vertical while in the storage position. The apparatus has a hinge mount that can be received on the small boat. There is a unitary mount for the outboard motor hinged to the hinge mount. A releasable lock attaches the unitary mount on the small boat to prevent hinging of the mount. There is a connector on the unitary mount remote from the hinge. A lift on the mother vessel is able to attach the connector on the unitary mount. There are abutments on the mother vessel and corresponding abutments on the small boat. These two abutments are able to engage each other to form a hinge about which the small boat can be pivoted during lifting by the lift.

U.S. Pat. No. 5,483,912 to Thomas discloses a small craft carrying device which includes a platform having two ends where one end is attached to the stern of a mother boat above the water line, a cradle attached to the other end of the platform in pivotal relationship so that the cradle can tilt towards and away from the mother boat, a sling for attaching to the small craft, and a power device for attaching to the sling for pulling the small craft onto the cradle and securing the small craft to the mother boat.

A disadvantage, however, to many prior art devices for launching or recovering a small boat or other vessel or marine vehicle from a mother vessel is that the small boat may tend to slide from side to side during such launching or recovering operations.

SUMMARY OF THE INVENTION

It is an object of the present invention to provide an apparatus for launching or recovering small boats or other vessels from a mother ship which provides a positive piston motion to avoid side to side motion.

The present invention is an apparatus for launching or retrieving a vessel. This apparatus includes a first vertical member having a top and a bottom end. A lower vessel engagement hook is positioned at the lower end of the vertical member. A second vertical member is positioned in parallel spaced relation to the first vertical member. An upper vessel engagement structure is positioned at the lower end of the second vertical member in spaced opposed relation to the lower vehicle engagement hook. The second vertical member moves axially upwardly and downwardly to allow for engagement with the vessel.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DESCRIPTION OF THE PREFERRED EMBODIMENT

Figure 1:
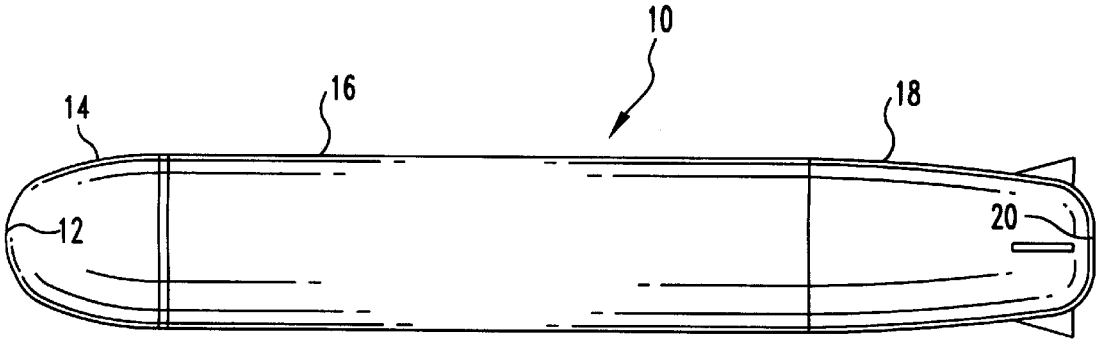
FIG. 1 is a side elevational view of a REMUS vehicle.
Figure 2:
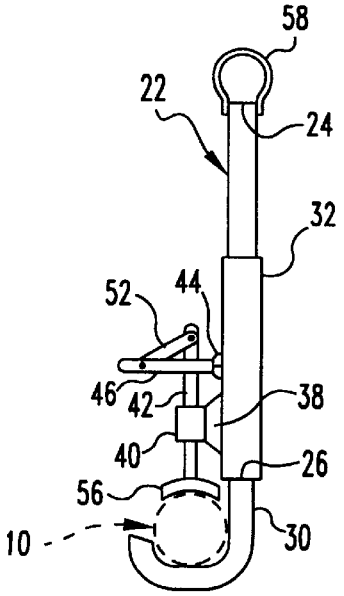
FIG. 2 is a side elevational view of a preferred embodiment of the tool of the present invention with the REMUS vehicle shown in FIG. 1 being shown in phantom lines.
Figure 3:
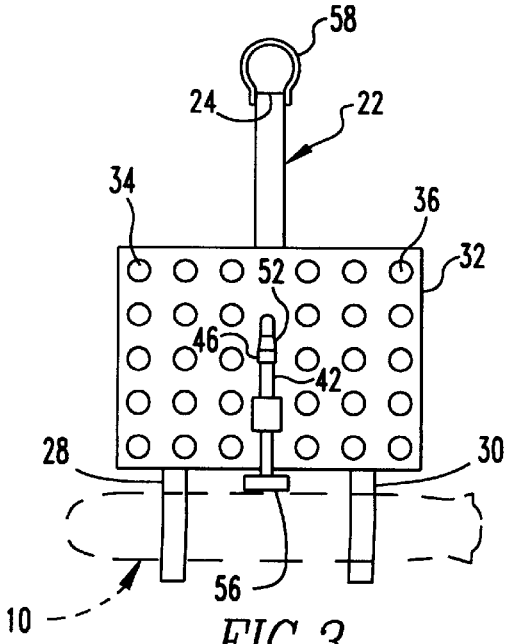
FIG. 3 is a front view of the tool shown in FIG. 2.
Figure 4:
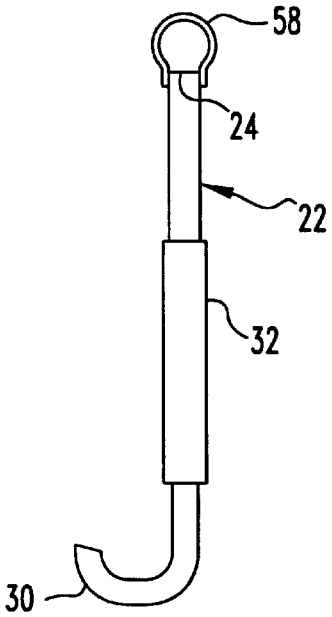
FIG. 4 is a side view of the major vertical support element and associated members of the tool shown in FIG. 1.
Figure 5:
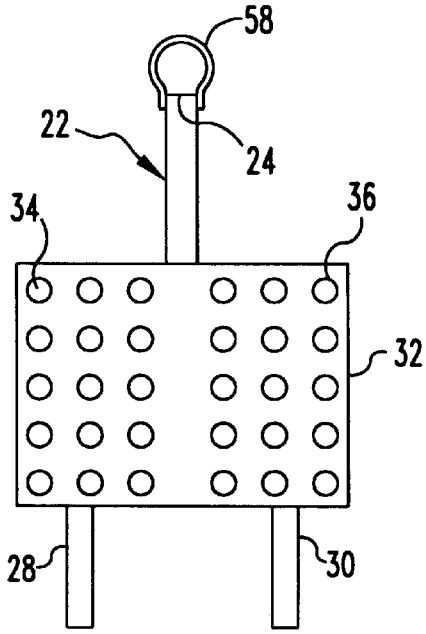
FIG. 5 is a front view of the part shown in FIG. 4.
Figure 6:
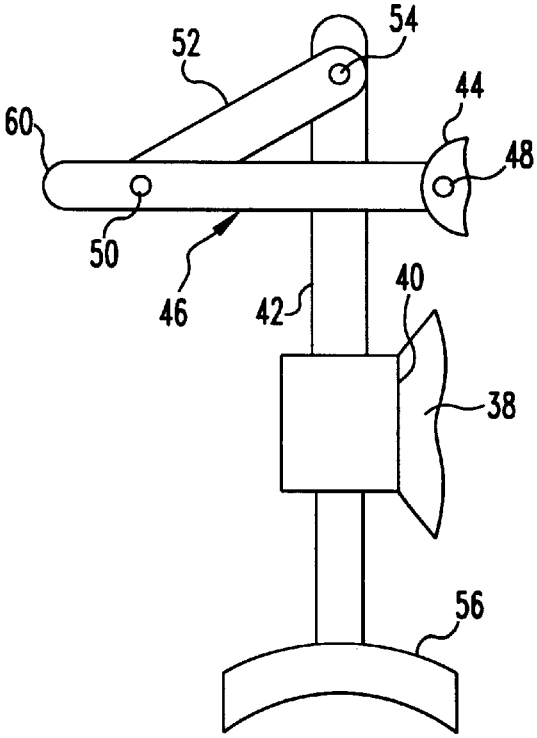
FIG. 6 is a side view of the handle and associated assembly shown in FIG. 1.

Referring to FIG. 1, a small countermeasure torpedo known as a REMUS vehicle is shown at 10. This vehicle has a bow 12 and a forward cylindrical shell 14, which has an increasing radius. There is also a constant diameter central section 16, a decreasing diameter rearward section 18 and the stern 20. Referring to FIGS. 2–6, the apparatus of the present invention includes a first vertical support 22 that has a top 24 and a bottom 26. At said bottom 26 there is a lower hook 28 and a parallel lower hook 30. The lower portion of first vertical support 22 comprises a vertical plate 32, which has a plurality of apertures as at aperture 34 and aperture 36. Extending from the vertical plate 32 is a first lateral support 38 and a cylindrical sleeve 40. A second vertical support 42 extends in parallel spaced relation to the first vertical support 22. Also extending from the vertical plate 32 there is an upper lateral support 44 on which a horizontal member 46 is mounted on a proximate pivot point 48. The horizontal member 46 also has a distal pivot point 50 where it engages an oblique member 52 which is connected to the second vertical support 42 at upper pivot point 54. The second vertical support 42 also extends through and below the cylindrical sleeve and supports a concave capture bracket 56, which is in opposed relation to the hooks 28 and 30. At the top 24 of the first vertical support 22 there is a lifting ring 58. The outer end of the horizontal support 46 forms a handle 60 for operation of the apparatus as is described below.

The apparatus described above is used in the following manner. The mother ship (not shown) is brought along side the REMUS vehicle 10. The apparatus is attached to a crane (not shown) on the mother ship by the lifting ring 58 and is positioned in the water adjacent the REMUS vehicle 10. The apparatus is maneuvered by hand such that the hooks 28 and 30 are underneath the REMUS vehicle 10. The apertures in the vertical plate 32 of the apparatus allow the apparatus to be more maneuverable in the water. The handle 60 is lowered by hand such that the capture bracket 56 contacts the REMUS vehicle 10, holding the vehicle 10 between the capture bracket 56 and the parallel lower hooks 28 and 30, as is shown in phantom lines in FIG. 2. The crane can then lift the tool with the attached REMUS vehicle 10 onto the deck of the ship.

The construction of this invention is designed to have the positive lock capture bracket 56 in an up position when approaching for retrieval. When close to the floating REMUS vehicle 10, the retrieval unit would be moved so that the REMUS vehicle 10 would be in the hooks 28 and 30. At this time, the capture bracket 56 secure vehicle 10.

It will be appreciated that an apparatus has been described for launching or recovering a small boat or other vessel or marine vehicle from a mother ship which provides a positive motion to avoid side to side motion of the small boat or other vessel or marine vehicle.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A launching and retrieving assembly comprising:

a first vertical member having a top and a bottom end;

a lower concave vehicle engagement means positioned at the lower end of the vertical member;

a second vertical member positioned in parallel spaced relation to the first vertical member;

an upper concave vehicle engagement means positioned at the lower end of the second vertical member in spaced opposed relation to the lower vehicle engagement means;

a cylindrically shaped torpedo; and means for moving the second vertical member axially upwardly and downwardly to allow engagement with the torpedo between the upper concave vehicle engagement means and the lower concave vehicle engagement means.

2. An apparatus for launching or retrieving a marine vessel comprising:

a first vertical member having a top and a bottom end;

a lower vehicle engagement means positioned at the lower end of the vertical member;

a second vertical member positioned in parallel spaced relation to the first vertical member, the second vertical member being moveably mounted in a cylindrical sleeve mounted on a lateral support extending from the first vertical member;

an upper vehicle engagement means positioned at the lower end of the second vertical member in spaced opposed relation to the lower vehicle engagement means; and means for moving the second vertical member axially upwardly and downwardly to allow engagement with the vessel.

3. The apparatus of claim 2 wherein the first vertical member has a suspension engagement means at its upper end.

4. The apparatus of claim 3 wherein the suspension engagement means is a ring.

5. The apparatus of claim 3 wherein the lower engagement means is concave.

6. The apparatus of claim 5 wherein the lower vehicle engagement means comprises a hook.

7. The apparatus of claim 6 wherein the lower vehicle engagement means comprises a pair of hooks.

8. The apparatus of claim 5 wherein the upper vehicle engagement means is concave.

9. The apparatus of claim 2 wherein a horizontal member having a proximate and a distal end is pivotably fixed at its proximate end to the first vertical member to be movable through a vertical arc, and said horizontal member is connected to the second vertical member to move said second vertical member in an upwardly and a downwardly direction.

10. The apparatus of claim 9 wherein there is a diagonal member having an upper and a lower end which is pivotally connected at its lower end to the horizontal member and is pivotally connected at its upper end to the second vertical member.

11. The apparatus of claim 10 wherein the distal end of the horizontal member moves upwardly in a vertical arc to move the second vertical member axially upwardly.

12. The apparatus of claim 11 wherein the distal end of the horizontal member moves downwardly in a vertical arc to move the second vertical member in a downward direction.

13. The apparatus of claim 2 wherein a lower portion of the first vertical member is comprised of a vertical plate.

14. The apparatus of claim 13 wherein there is a plurality of transverse apertures in the vertical plate.

15. The apparatus of claim 2 wherein the vessel, which is launched or recovered, is a submersible marine vehicle.

16. The apparatus of claim 15 wherein the marine vehicle is generally cylindrically shaped.

17. The apparatus of claim 2 adapted to have the marine vessel interposed between the upper and lower vessel engagement means.

18. The apparatus of claim 17 adapted to provide a positive lock to the marine vessel.

19. The apparatus of claim 2 wherein the marine vessel is a torpedo.

20. The apparatus of claim 8 adapted to hold a generally cylindrical shaped torpedo between the upper vehicle engagement means and the lower vehicle engagement means.

* * * * *